US005267366A

United States Patent [19]

Frazer

[11] Patent Number: 5,267,366

[45] Date of Patent: Dec. 7, 1993

[54] COMBINATION HAND TOOL WITH RETRACTABLE PLIERS JAWS

[76] Inventor: Spencer Frazer, P.O. Box 1024, Edmonds, Wash. 98020

[21] Appl. No.: 891,990

[22] Filed: May 27, 1992

[51] Int. Cl.[5] ..... B25F 1/04

[52] U.S. Cl. ..... 7/128; 7/168

[58] Field of Search ..... 7/125, 127, 128, 129, 7/130, 131, 167, 132, 168, 133, 118; 30/255; 81/427.5, 415

[56] References Cited

U.S. PATENT DOCUMENTS

| | | | |
|---|---|---|---|
| Des. 137,408 | 3/1944 | Frisk . | |
| 589,392 | 8/1897 | Kolar . | |
| 596,096 | 12/1897 | Watts . | |
| 614,537 | 11/1898 | Dahlquist . | |
| 649,334 | 5/1900 | Meloos . | |
| 662,005 | 11/1900 | Lewis . | |
| 790,432 | 5/1905 | Heilrath . | |
| 857,459 | 6/1907 | Hendrickson . | |
| 896,746 | 8/1908 | McCarty . | |
| 1,184,746 | 5/1916 | Hanson . | |
| 1,370,906 | 3/1921 | Newton . | |
| 1,467,661 | 9/1923 | Undy . | |
| 1,524,694 | 2/1925 | Di Maio . | |
| 1,561,993 | 11/1925 | Nielsen . | |
| 3,798,687 | 3/1974 | Stevens | 7/5.1 |
| 4,238,862 | 12/1980 | Leatherman | 7/128 |
| 4,512,051 | 4/1985 | Magan | 7/128 |
| 4,744,272 | 5/1988 | Leatherman | 81/427.5 |
| 5,062,173 | 11/1991 | Collins et al. | 7/118 |
| 5,142,721 | 9/1992 | Sessions et al. | 7/128 |

FOREIGN PATENT DOCUMENTS

| | | | |
|---|---|---|---|
| 30788 | 3/1885 | Fed. Rep. of Germany . | |
| 0277412 | 11/1951 | Switzerland | 7/128 |
| 1002145 | 3/1983 | U.S.S.R. | 7/128 |

*Primary Examiner*—Roscoe V. Parker
*Attorney, Agent, or Firm*—Christensen, O'Connor, Johnson & Kindness

[57] ABSTRACT

Jaw members are pivoted together such that cooperating working end portions of the jaw members are movable toward and away from each other. The jaw members have tang or butt portions extending opposite the pivot from the working end portions. Such butt portions are, in turn, pivoted to elongated handles which are channel shaped and define a recess between them into which the interconnected jaw members can be swung so as to be nested in the handles. The pivots connecting the butt portions of the jaw members to the handles are not coaxial but rather are mutually oblique in such a manner that swinging of the jaw members from the retracted or nested position to the working position necessarily results in spreading the handles relatively apart. Similarly, movement of the jaw members from the projected position to the retracted or nested position automatically swings the handles together. Mechanism is provided to interconnect the handles automatically when the jaw members are retracted.

12 Claims, 4 Drawing Sheets

COMBINATION HAND TOOL WITH RETRACTABLE PLIERS JAWS

FIELD OF THE INVENTION

The present invention relates to a compound tool. More specifically, the present invention relates to a compound tool having cooperating jaws retractable into handles of the tool.

BACKGROUND OF THE INVENTION

Collins et al. U.S. Pat. No. 5,062,173, issued Nov. 5, 1991, discloses a "Multifunction Tool" including pliers jaws having respective tangs or butt portions remote from the cooperating work end portions of the jaws. The butt portions are pivoted to channel-shaped handles. The handle pivots for the separate butt portions are coaxial, enabling the jaws to be swung from a normal working position in which the handles form extensions of the butt portions of the jaws to a retracted position in which the jaws are nested inside the handles. Pocket knife type implements can be separately pivoted to the channel-shaped handles.

Other types of compound tools having cooperating jaws (such as pincers, pliers, shears or scissors) are disclosed in German Patentschrift No. 30788, issued Aug. 14, 1884, and in the following U.S. patents: Kolar U.S. Pat. No. 589,392, issued Aug. 31, 1897; Meloos U.S. Pat. No. 649,334, issued May 8, 1900; Lewis U.S. Pat. No. 662,005, issued Nov. 20, 1900; Heilrath U.S. Pat. No. 790,432, issued May 23, 1905; McCarty U.S. Pat. No. 896,746, issued Aug. 25, 1908; Newton U.S. Pat. No. 1,370,906, issued Mar. 8, 1921; Undy U.S. Pat. No. 1,467,661, issued Sep. 11, 1923; Di Maio U.S. Pat. No. 1,524,694, issued Feb. 3, 1925; Nielsen U.S. Pat. No. 1,561,993, issued Nov. 17, 1925; Frisk U.S. Pat. No. Des. 137,408, issued Mar. 7, 1944; Leatherman U.S. Pat. No. 4,238,862, issued Dec. 16, 1980; and leatherman U.S. Pat. No. 4,744,272, issued May 17, 1988.

SUMMARY OF THE INVENTION

The present invention provides a multipurpose tool having jaw members pivoted together such that cooperating working end portions of the jaw members are movable toward and away from each other. The jaw members have tang or butt portions extending opposite the pivot from the working end portions. Such butt portions are, in turn, pivoted to elongated handles. The handles are channel shaped and define a recess between them into which the interconnected jaw members can be swung so as to be nested in the handles. The pivots connecting the butt portions of the jaw members to the handles are not coaxial. Rather, such pivots are oblique to such a degree that swinging the jaw members from the retracted or nested position to the working position necessarily results in swinging the handles relatively apart. Preferably, mechanism is provided to interconnect the two handles when the jaw members are retracted. Other pocket knife type implements can be carried by the handles.

DETAILED DESCRIPTION OF THE PREFERRED EMBODIMENT

The present invention provides a tool in which pocket knife type implements can be pivotally mounted in opposing handles and in which such handles are joined to a tool of the type having cooperating jaws pivoted together. In addition, the jaws are swingable relative to the handles from a projected normal working position to a more compact, retracted position.

Figure 1:
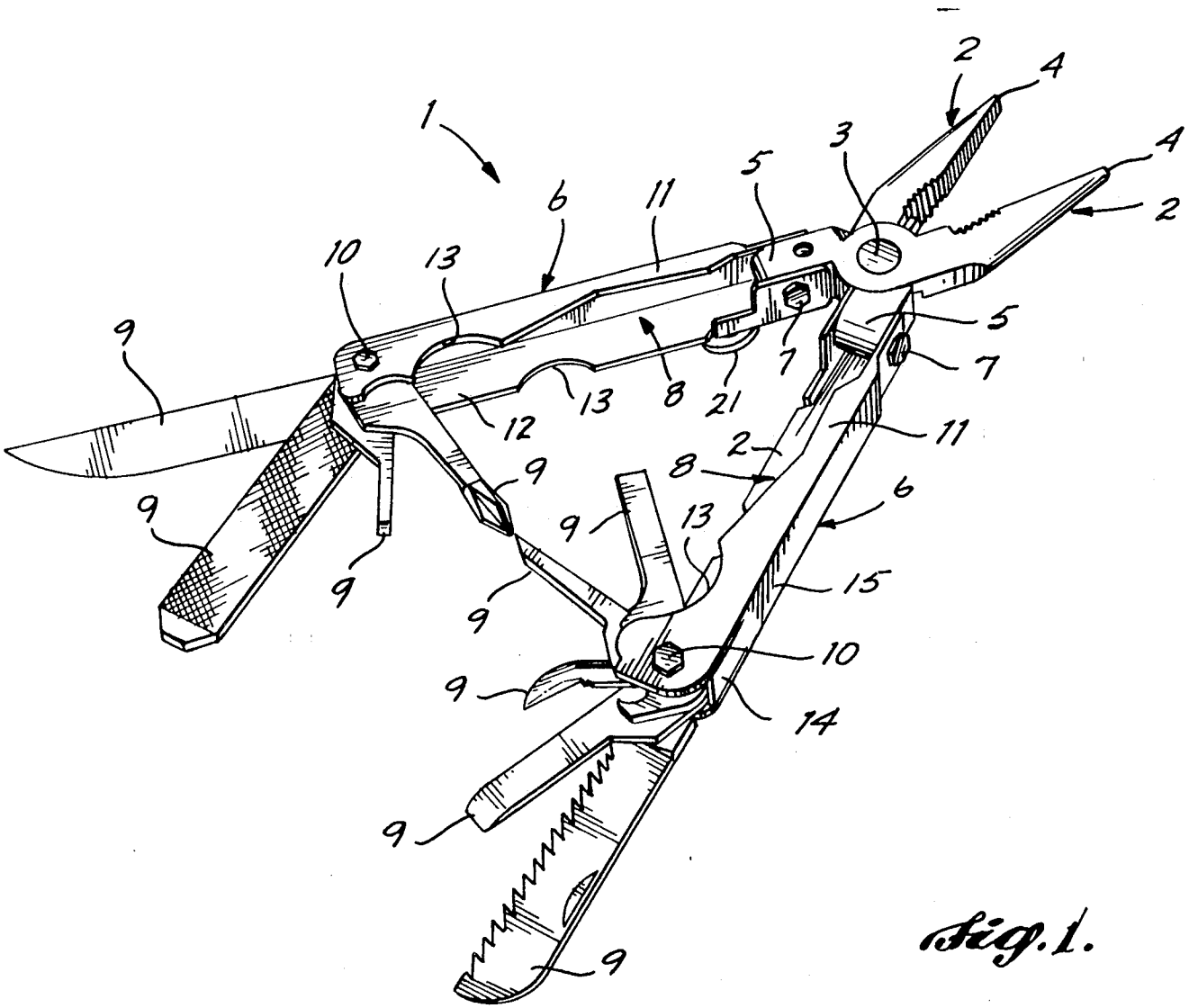
FIG. 1 is a top perspective of a combination hand tool with retractable pliers jaws in accordance with the present invention.

FIG. 1 illustrates a combination tool 1 in accordance with the present invention with each of its implements in projected or partially projected position. Such tool includes opposing cooperating jaw members 2 connected by a pivot 3 for swinging movement of working end portions 4 of such jaw members relatively toward and away from each other. In the preferred embodiment, the jaw members are pliers jaws and the working end portions are swingable from the open position illustrated in FIG. 1 to a closed position in which the facing surfaces of the working end portions 4 are in clamping engagement. Each jaw member 2 includes a tang or butt portion 5 extending from the pivot 3 oppositely from the corresponding working end portion 4.

The butt portions 5 of the jaws are connected to elongated handles 6 by pivots 7 which extend perpendicularly to the pivot 3. Each handle is swingable transversely of its length about the axis of its pivot 7 relative to the jaw member 2 to which it is connected. In the open position shown in FIG. 1, each handle forms an extension of the jaw member tang or butt 5 to which such handle is connected.

Preferably, each handle 6 defines a channel 8 opening inward toward the channel of the other handle. Such channels can receive pocket knife implements 9 which preferably are connected by pivots 10 to the end portions of the handles 6 opposite the portions pivoted to the jaw members 2. When retracted, the implements 9 are fitted between top and bottom plates 11 and 12, respectively, of the handles 6. Such plates can have finger notches 13 for access to edge portions of the retracted implements. Preferably, the base of each implement is engaged by a leaf spring 14 formed as an extension of the vertical side plate or web 15 connecting the corresponding top and bottom plates 11 and 12. The leaf spring also can limit the degree to which an implement can be swung open by engaging in a notch in the base of an implement when such implement has been swung so as to extend substantially longitudinally away from its handle.

Figure 2:
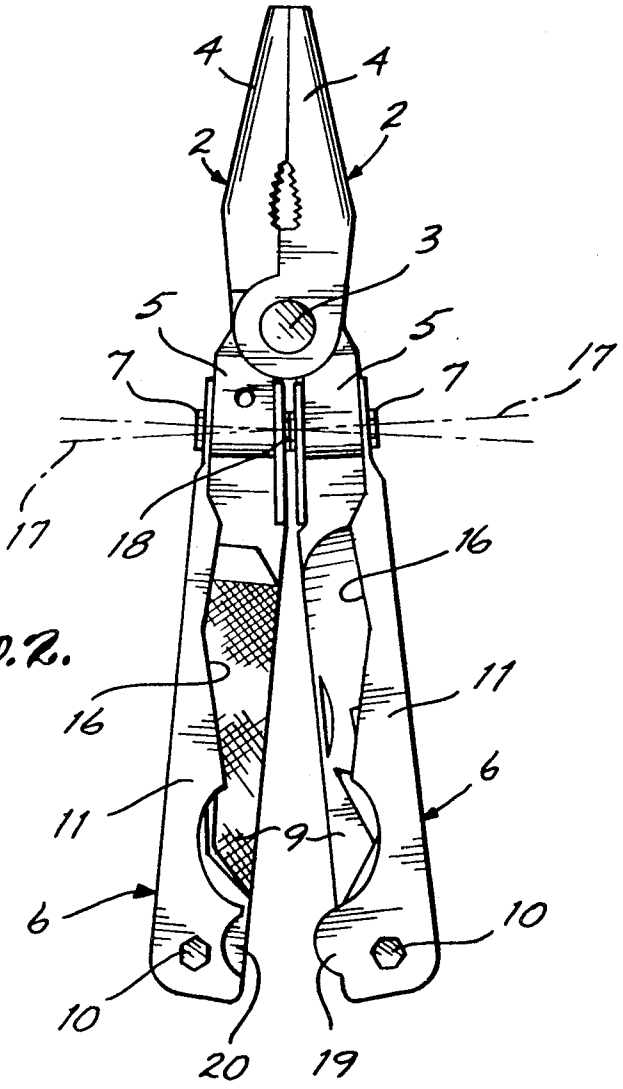
FIG. 2 is a top plan of the tool of FIG. 1 with the pliers jaws projected from handles of such tool.

FIG. 2 illustrates the relative positions of the parts when the pocket knife implements 9 are retracted into the channels of the handles 6 and the handles are swung so as to extend longitudinally away from the butt portions 5 of the jaw members 2. The handles can be manipulated for moving the working end portions 4 of the jaw members. However, the top plates 11 of the handles have large cutouts 16 so as to form an upward-opening recess of approximately the same shape as the profile of the jaw members when their working ends are in engagement as shown in FIG. 2. Consequently, the jaw members can be swung about the axes 17 of the pivots 7 to the position indicated in FIG. 3 in which the jaw members are compactly nested in the handles. However, the axes 17 are not coaxial as in the device of U.S. Pat. No. 5,062,173, for example, but rather are oblique so as to cross at approximately the centerline of the tool. From the point of intersection 18 of the axes, each axis extends outward and slightly toward the free end of the corresponding handle 6.

Figure 3:
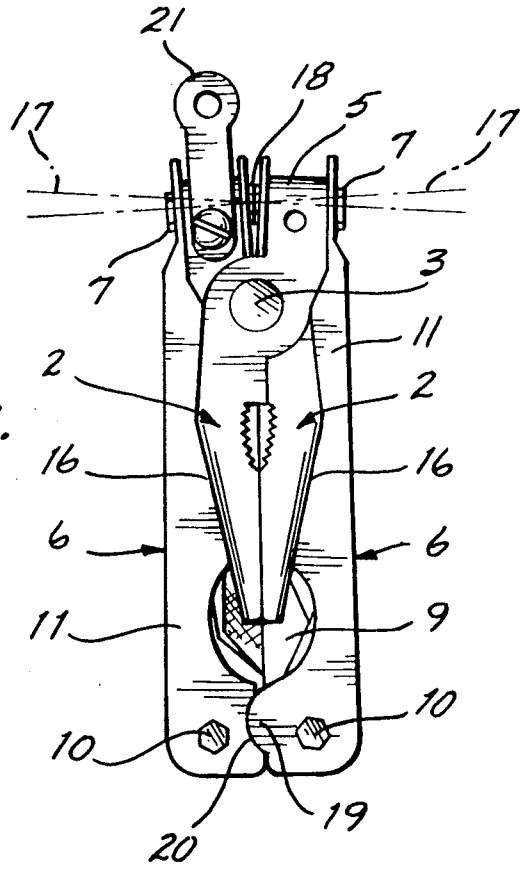
FIG. 3 is a corresponding to plan, but with the pliers jaws retracted into the handles of the tool.
Figure 6:
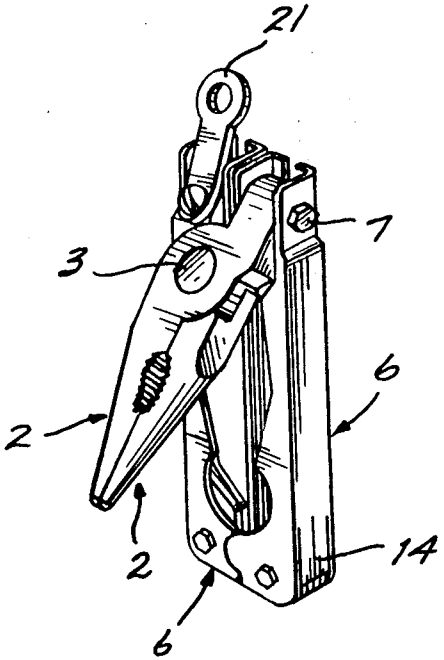
FIGS. 4, 5 and 6 are corresponding perspectives illustrating retraction of the pliers jaws from a fully open condition toward a retracted condition.
Figure 5:
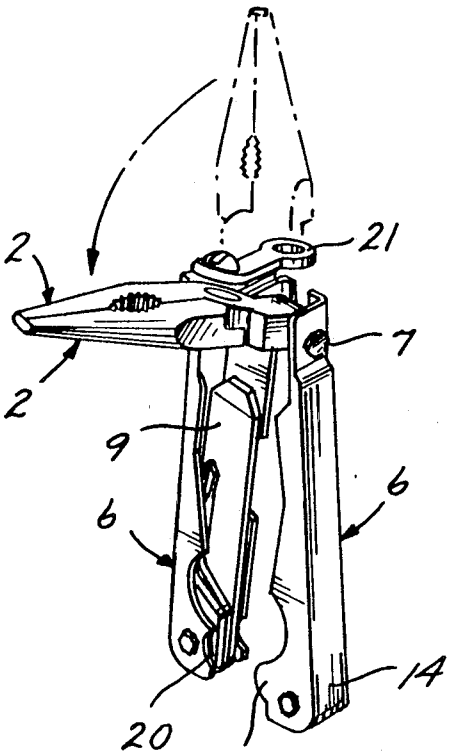
Figure 4:
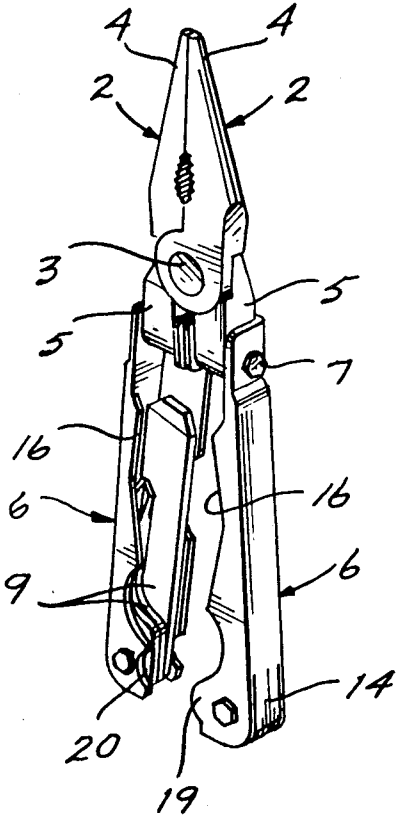

The effect of providing the oblique axes for the pivots 7 is best described with reference to FIGS. 4, 5, and 6, which illustrate retracting movement of the cooperating jaw members 2. As such jaw members are swung from the projected position illustrated in FIG. 4 toward the retracted position illustrated in FIG. 3 the handles are gradually brought together as illustrated in FIG. 5 and FIG. 6. Preferably, the handle members interlock as the plier jaws are retracted and the handles are brought together. In the illustrated embodiment, the top and bottom plates of one handle have inward-extending projections 19 which are received in correspondingly shaped notches 20 of the top and bottom plates of the other handle member. The projections fit in the notches to embrace the projecting edge portions of the implements 9 of the notched handle member. Thus, when the pliers jaws are brought to the retracted position, the handle members interlock and cannot be moved independently of each other.

For the reverse action of swinging the jaw members to the projected position, the handles are automatically spread apart until the position of FIG. 2 is reached. A greater gripping force can be exerted by use of the spread-apart handle members than in the device of U.S. Pat. No. 5,062,173, for example, in which the handle members extend parallel and have inner sides in substantially contiguous engagement when the jaw members are swung open.

For ease in moving the jaw members from the retracted position to the projected position, preferably a tab 21 is provided on the butt portion 5 of one of the jaw members. Such tab projects outward beyond the end of the butt portion, opposite the associated clamping end portion, and beyond the end of the corresponding handle member as seen in FIG. 3 and FIG. 6, for example. Pushing on the tab while grasping the handles tends to swing the jaw members toward the projected position.

Figure 7:
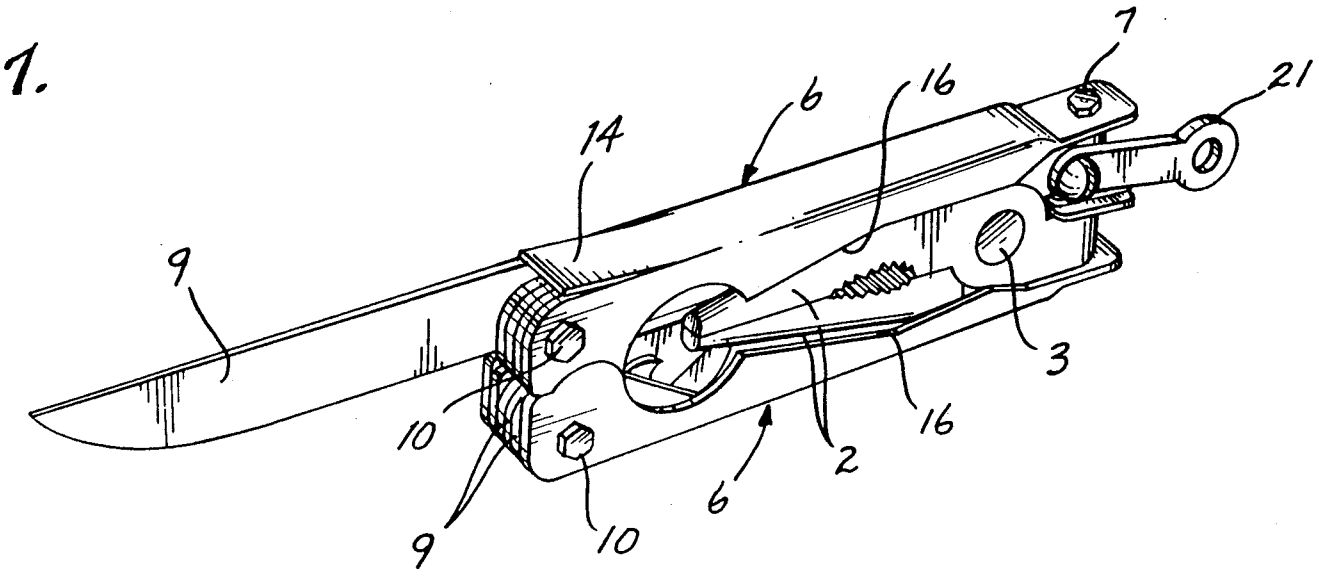
FIG. 7 is a perspective illustrating a different working position of the combination tool of FIG. 1.

The automatic interlocking of the handles helps to retain them in compact side-by-side condition when the jaw members are retracted. In addition, such interlocking allows a convenient working position for a pocket knife implement. When the jaw members are projected from the handles, a selected implement can be swung to its open position, whereupon the jaw members can be swung to their nested or retracted position so as to interlock the handles together. As shown in FIG. 7, the projected implement 9 will be in a projected working position with the interlocked side-by-side handles forming a convenient grip allowing manipulation of the implement without danger of the implement closing on the hand of the user.

The embodiments of the invention in which an exclusive property or privilege is claimed are defined as follows:

1. In a tool including cooperating jaw members connected by a pivot and having working end portions extending in one direction from the pivot and butt portions extending in the opposite direction from the pivot, such tool including elongated handles having corresponding end portions pivotally connected to the butt portions of the jaw members, respectively, such that the jaw members are swingable between a projected position in which the handles form extensions of the jaw member butt portions and a retracted position in which the jaw members are substantially nested in the handles, the improvement comprising the pivots connecting the jaw member butt portions to the respective handles being noncoaxial and extending obliquely relative to each other such that the handles are automatically spread relatively apart as the jaw members are moved from the retracted position to the projected position and are automatically swung relatively together as the jaw members are moved from the projected position to the retracted position.

2. In the tool defined in claim 1, means for automatically interlocking the handle members by movement of the jaw members from the projected position to the retracted position.

3. In the tool defined in claim 2, the interlocking means including a projection formed on one of the handles and extending generally toward the other handle and a recess formed in the other handle and positioned to receive the projection.

4. In the tool defined in claim 2, each handle forming a channel opening toward the channel of the other handle, and including pocket knife implements pivotally mounted in said channels for swinging between positions received in the channels and positions projecting from the channels.

5. In the tool defined in claim 4, the implements being mounted for swinging about axes disposed at the end portions of the handles opposite the end portions pivotally connected to the jaw member butt portions.

6. In the tool defined in claim 4, each handle having a top plate, a bottom plate and a web interconnecting said plates and positioned to form the channels, the interlocking means including interlocking notches and projections formed on the top and bottom plates of the handles.

7. In the tool defined in claim 1, including a tab extending from at least one of the jaw member butt portions and projecting beyond such butt portion opposite the working end portion of the associated jaw member for ease in swinging the jaw members from the retracted position to the projected position.

8. In a tool including cooperating jaw members connected by a pivot and having working end portions extending in one direction from the pivot and butt portions extending in the opposite direction from the pivot, such tool including elongated handles having corresponding end portions pivotally connected to the butt portions of the jaw members, respectively, such that the jaw members are swingable between a projected position in which the handles form extensions of the jaw member butt portions and a retracted position in which the jaw members are substantially nested in the handles, the improvement comprising each handle forming a channel opening toward the channel of the other handle, and including pocket knife implements pivotally mounted in said channels for swinging about axes disposed at the end portions of the handles opposite the end portions pivotally connected to the jaw member butt portions, said implements being swingable between positions received in the channels and positions projecting from the channels, and means for automatically interlocking the handle members by movement of the jaw members from the projected position to the retracted position.

9. In a tool including cooperating jaw members connected by a pivot and having working end portions extending in one direction from the pivot and butt portions extending in the opposite direction from the pivot, such tool including elongated handles having corresponding end portions pivotally connected to the butt portions of the jaw members, respectively, such that the jaw members are swingable between a projected position in which the handles form extensions of the jaw member butt portions and a retracted position in which the jaw members are substantially nested in the handles, the improvement comprising a tab extending from at least one of the jaw member butt portions and projecting beyond such butt portion oppositely from the working end portion of the associated jaw member for ease in swinging the jaw members from the retracted position to the projected position.

10. In the tool defined in claim 9, the improvement further comprising means for automatically interlocking the handle members by movement of the jaw members from the projected position to the retracted position.

11. In the tool defined in claim 9, the improvement further comprising each handle forming a channel opening toward the channel of the other handle, and including pocket knife implements pivotally mounted in said channels for swinging about axes disposed at the end portions of the handles opposite the end portions pivotally connected to the jaw member butt portions, said implements being swingable between positions received in the channels and positions projecting from the channels.

12. In a tool including cooperating jaw members connected by a pivot defining a first axis, such jaw members having working end portions extending in one direction from the pivot and butt portions extending in the opposite direction from the pivot, such tool including elongated handles having corresponding end portions pivotally connected to the butt portions of the jaw members, respectively, such that the jaw members are swingable independently of movement of the jaw members about the first axis between a projected position in which the handles form extensions of the jaw member butt portions and a retracted position in which the jaw members are substantially nested in the handles, the improvement comprising each of the handles having a top plate, a bottom plate spaced below the top plate and a side plate connecting corresponding edges of said top and bottom plates remote from the other of the handles to form a channel having an opening facing the channel of the other of the handles, and including pocket knife implements pivotally mounted in said channels for swinging through said channel openings, toward and away from said side plates, about axes disposed at the end portions of the handles opposite the end portions pivotally connected to the jaw member butt portions, said implements being swingable between positions received in the channels between the top and bottom plates and positions projecting from the channels generally lengthwise of the handles, and means for automatically interlocking the handle members by movement of the jaw members from the projected position to the retracted position.

* * * * *